US008660276B2

(12) United States Patent
Lin et al.

(10) Patent No.: US 8,660,276 B2
(45) Date of Patent: Feb. 25, 2014

(54) DRIVING CIRCUIT FOR A SOUND OUTPUTTING APPARATUS

(75) Inventors: Chang-Chih Lin, Taipei (TW); Hung-Dar Wang, Kaohsiung (TW); Pei-Cheng Huang, Taipei (TW)

(73) Assignee: Ricktek Technology Corp., Chupei, Hsinchu (TW)

( * ) Notice: Subject to any disclaimer, the term of this patent is extended or adjusted under 35 U.S.C. 154(b) by 279 days.

(21) Appl. No.: 13/309,397

(22) Filed: Dec. 1, 2011

(65) Prior Publication Data

US 2012/0140958 A1 Jun. 7, 2012

(30) Foreign Application Priority Data

Dec. 6, 2010 (TW) ..... 99142349 A

(51) Int. Cl.
*H04R 3/00* (2006.01)

(52) U.S. Cl.
USPC ..... 381/111; 381/120; 330/10; 330/251

(58) Field of Classification Search
USPC ..... 381/120, 121, 74, 28, 111, 123, 107, 381/94.5; 330/10, 251–153, 277, 297, 69, 330/207 A
See application file for complete search history.

(56) References Cited

U.S. PATENT DOCUMENTS

| | | | | |
|---|---|---|---|---|
| 6,211,728 | B1 | 4/2001 | Chen et al. | |
| 7,061,328 | B2 | 6/2006 | Doy | |
| 7,209,003 | B2 | 4/2007 | Chen et al. | |
| 7,515,980 | B2 | 4/2009 | Watanabe | |
| 7,701,294 | B1 | 4/2010 | Yun | |
| 8,330,541 | B2 * | 12/2012 | Cerutti | 330/207 A |
| 8,427,235 | B2 * | 4/2013 | Williams | 330/251 |
| 8,558,617 | B2 * | 10/2013 | Cerutti | 330/207 A |
| 2002/0060605 | A1 * | 5/2002 | Kowkutla et al. | 330/10 |
| 2004/0125968 | A1 * | 7/2004 | Pearce et al. | 381/120 |
| 2004/0239417 | A1 * | 12/2004 | Kowkutla et al. | 330/10 |

* cited by examiner

*Primary Examiner* — Vivian Chin
*Assistant Examiner* — Friedrich W Fahnert
(74) *Attorney, Agent, or Firm* — Muncy, Geissler, Olds & Lowe, P.C.

(57) ABSTRACT

A driving circuit for a sound outputting apparatus includes a H-bridge and a charge pump established by six switches for driving two types of loudspeakers, respectively. The six switches include two common switches to be configured in the H-bridge and the charge pump, thereby reducing the costs and circuit area of the driving circuit.

3 Claims, 3 Drawing Sheets

DRIVING CIRCUIT FOR A SOUND OUTPUTTING APPARATUS

FIELD OF THE INVENTION

The present invention is related generally to a sound outputting apparatus and, more particularly, to a driving circuit for single sound outputting.

BACKGROUND OF THE INVENTION

Generally, the driving circuit of speakers employs class-D amplifier or other power MOS driving scheme, most of which is implemented by an H-bridge configuration, for example, see U.S. Pat. Nos. 6,211,728 and 7,209,003. For headphones, due to the consideration for acoustic fidelity requirements, the driving circuit needs both positive and negative voltage sources, and thus often employs a charge pump to generate the needed negative voltage, for example, see U.S. Pat. Nos. 7,061,328 and 7,701,294.

As shown in FIG. 1, for driving a speaker 10, the conventional H-bridge 12 includes switches SW1 and SW2 connected in series between voltage input terminals 14 and 16, and switches SW3 and SW4 connected in series between voltage input terminals 18 and 20. By switching the switches SW1, SW2, SW3 and SW4, a voltage Vout is generated between switch nodes 22 and 24 for driving the speaker 10. FIG. 2 shows a conventional charge pump, which includes switches SW5 and SW6 connected in series between voltage input terminals 26 and 28, switches SW7 and SW8 connected in series between a voltage output terminal 30 and a voltage input terminal 32, and a flying capacitor Cflying connected between switch nodes 34 and 36. By switching the switches SW5, SW6, SW7 and SW8, the positive supply voltage VDD is converted into a negative voltage −VDD at the voltage output terminal 30.

Many commercial sound outputting apparatuses are capable of driving a speaker and a headphone, which use an H-bridge for driving the speaker and a charge pump for driving the headphone, for example, see U.S. Pat. No. 7,515,980. Therefore, such device has eight switches and thus requires larger circuit area and higher costs.

SUMMARY OF THE INVENTION

An objective of the present invention is to provide a driving circuit for a sound outputting apparatus.

Another objective of the present invention is to reduce the costs and circuit area of a driving circuit capable of driving two types of loudspeakers.

According to the present invention, a driving circuit for a sound outputting apparatus includes six switches and a flying capacitor. Four of the six switches are configured as an H-bridge for driving a first type loudspeaker, and the other two of the six switches, two of the four switches of the H-bridge and the flying capacitor are configured as a charge pump for generating a voltage that is required for driving a second type loudspeaker.

In the driving circuit of the present invention, the H-bridge and the charge pump share two of the six switches, thereby reducing the number of the switches and thus saving costs and circuit area.

BRIEF DESCRIPTION OF THE DRAWINGS

These and other objectives, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 1:
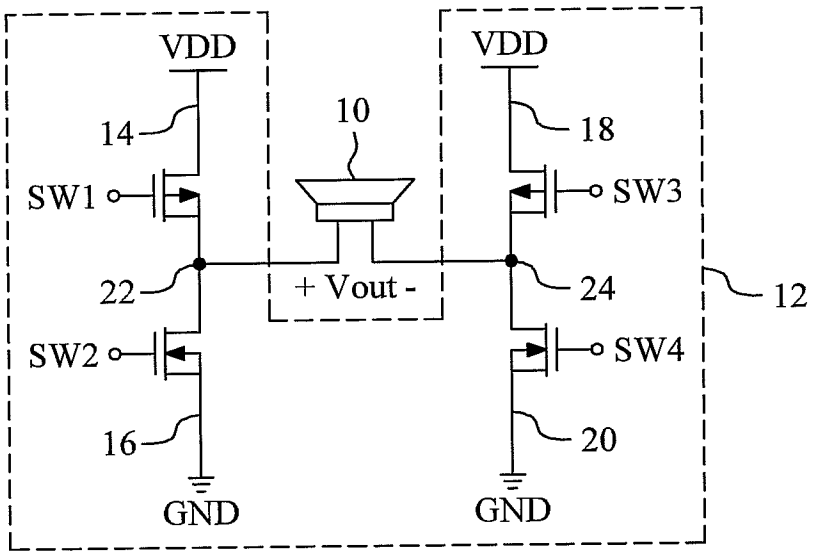
Fig. 1 Prior Art
FIG. 1 is a circuit diagram of an H-bridge for driving a speaker.
Figure 2:
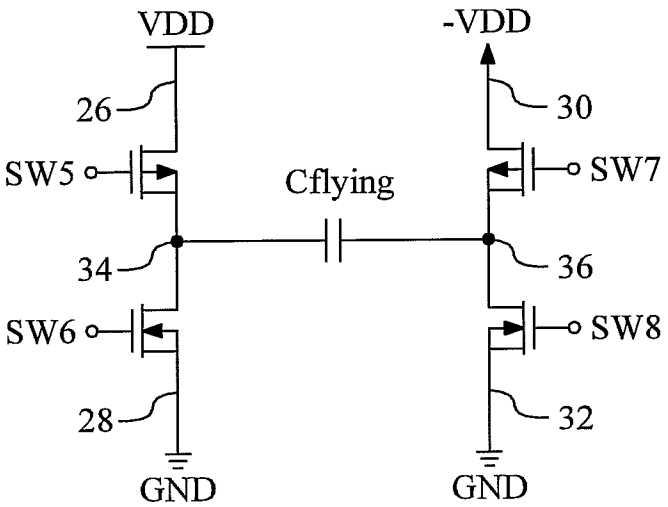
Fig. 2 Prior Art
FIG. 2 is a circuit diagram of a charge pump for generating a negative voltages from a positive voltage.
Figure 3:
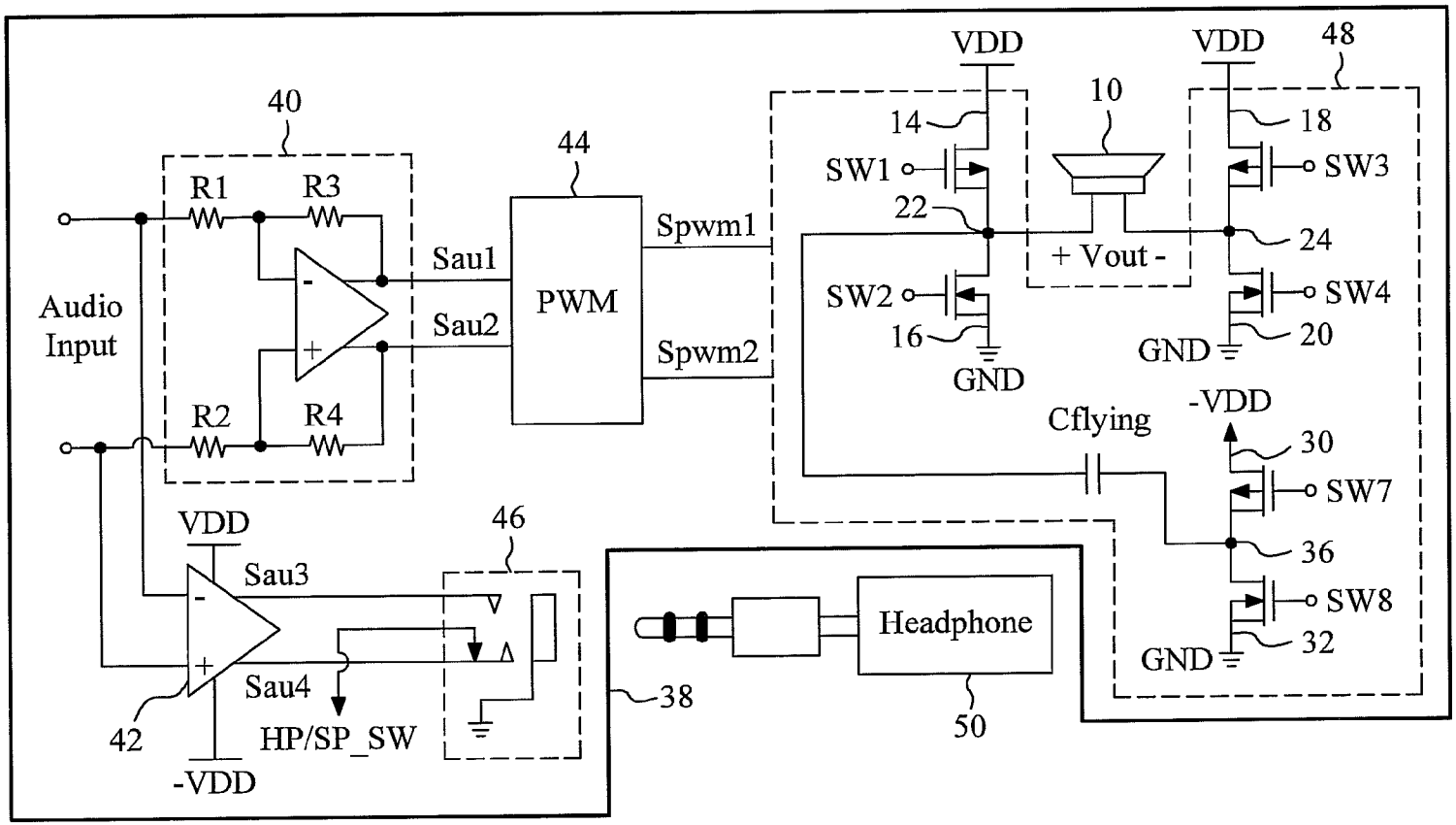
FIG. 3 is a circuit diagram of a sound outputting apparatus using a driving circuit according to the present invention.

Referring to FIG. 3, a sound outputting apparatus 38 includes a driving circuit 48 according to the present invention. In addition to the driving circuit 48, the sound outputting apparatus 38 further includes a pre-amplifier 40 for amplifying the input signal received from an audio input of the sound outputting apparatus 38 to generate a pair of differential signals Sau1 and Sau2, a pulse width modulator (PWM) 44 responsive to the differential signals Sau1 and Sau2 to generating PWM signals Spwm1 and Spwm2 supplied to the driving circuit 48, an headphone-connecting terminal 46 for connecting an external headphone 50, and an headphone amplifier 42 for amplifying the input signal received from the audio input to generate a pair of differential signals Sau3 and Sau4 supplied to the headphone-connecting terminal 46. In the driving circuit 48, common switches SW1 and SW2 are connected in series between voltage input terminals 14 and 16, switches SW3 and SW4 are connected in series between voltage input terminals 18 and 20, switches SW7 and SW8 are connected in series between a voltage output terminal 30 and a voltage input terminal 32, a flying capacitor Cflying is connected between switch nodes 22 and 36, and switch nodes 22 and 24 for connecting a speaker 10.

When there is no headphone connected to the headphone-connecting terminal 46, the sound outputting apparatus 38 is in a first mode, in which the switches SW7 and SW8 of the driving circuit 48 remain open circuit, the voltage input terminals 14 and 18 have a same voltage VDD, the voltage input terminals 16 and 20 are grounded, and the switches SW1, SW2, SW3 and SW4 configured as an H-bridge are switched according to the PWM signals Spwm1 and Spwm2 to generate a voltage Vout between the switch nodes 22 and 24 for driving a speaker 10.

If the headphone-connecting terminal 46 is connected with a headphone 50, it will generate a switch signal HP/SP_SW to switch the sound outputting apparatus 38 to a second mode, in which the switches SW3 and SW4 of the driving circuit 48 remain open circuit, the voltage input terminal 14 has a voltage VDD, the voltage input terminals 16 and 32 are grounded, the switches SW1, SW2, SW7 and SW8 and the flying capacitor Cflying establish a charge pump to convert the positive voltage VDD to a negative voltage −VDD by switching the switches SW1, SW2, SW7 and SW8, at the voltage output terminal 30 for supplying to the headphone amplifier 42. After enabled, the headphone amplifier 42 generates the signals Sau3 and Sau4 responsive to the input signal received from the audio input for driving the headphone 50 via the headphone-connecting terminal 46.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A driving circuit for a sound outputting apparatus, comprising:

first and second switches connected via a first switch node and in series between a first voltage input terminal and a second voltage input terminal;

third and fourth switches connected via a second switch node and in series between a third voltage input terminal and a fourth voltage input terminal, such that the first to fourth switch are configured as an H-bridge when the driving circuit is in a first mode;

fifth and sixth switches connected via a third switch node and in series between a voltage output terminal and a fifth voltage input terminal; and a flying capacitor connected between the first switch node and the third switch node, such that the first, second, fifth and sixth switches and the flying capacitor are configured as a charge pump when the driving circuit is in a second mode;

wherein in the first mode, the fifth and sixth switches remain open circuit, and the H-bridge generates a first voltage between the first and second switch nodes for driving a first type loudspeaker, and in the second mode, the third and fourth switches remain open circuit, and the charge pump generates a second voltage at the voltage output terminal for driving a second type loudspeaker.

2. The driving circuit of claim 1, wherein in the first mode, the first and third voltage input terminals have a same third voltage, and the second, fourth and fifth voltage input terminals have a same fourth voltage.

3. The driving circuit of claim 1, wherein in the second mode, the first voltage input terminal has a third voltage, and the second and third voltages are opposite in polarity.

* * * * *